United States Patent [19]

Blackmer et al.

[11] Patent Number: 4,706,287

[45] Date of Patent: Nov. 10, 1987

[54] STEREO GENERATOR

[75] Inventors: David E. Blackmer, Wilton, N.H.; James H. Townsend, Jr., Cambridge, Mass.

[73] Assignee: Kintek, Inc., Waltham, Mass.

[21] Appl. No.: 679,881

[22] Filed: Dec. 10, 1984

Related U.S. Application Data

[63] Continuation-in-part of Ser. No. 661,658, Nov. 17, 1984, abandoned.

[51] Int. Cl.[4] ..... H04S 5/00

[52] U.S. Cl. ..... 351/17; 381/63

[58] Field of Search ..... 381/1, 17, 18, 62, 63; 84/DIG. 26

[56] References Cited

U.S. PATENT DOCUMENTS

| | | | |
|---|---|---|---|
| 3,219,757 | 11/1965 | Palladino | 381/17 |
| 3,670,106 | 6/1972 | Orban | 381/17 |
| 3,714,462 | 1/1973 | Blackmer | 330/293 |
| 4,359,605 | 11/1982 | Haramoto et al. | 381/17 |
| 4,404,427 | 9/1983 | Blackmer | 381/17 |

OTHER PUBLICATIONS

Chamberlin, Musical Applications of Microprocessors, 1980, pp. 447–451.

J. Cohen, "Enhance TV Sound with Stereo", Popular Electronics, Jun. 1982, pp. 55–59.

*Primary Examiner*—Forester W. Isen

*Attorney, Agent, or Firm*—Schiller, Pandiscio & Kusmer

[57] ABSTRACT

An improved system is disclosed for generating a signal encoded with stereophonic information and adapted to be used with a monophonic signal to synthesize stereophonic reproduction. The system includes means for generating the encoded signal as a function of at least a portion of the program information of a monophonic input signal so as to control the amount of stereophonic spread provided during stereophonic reproduction provided by the encoded signal and a monophonic signal derived from the monophonic input signal. The system is particularly adapted for use in the transmission and/or reception of stereophonic television signals.

21 Claims, 4 Drawing Figures

STEREO GENERATOR

The present application is a continuation-in-part of U.S. patent application Ser. No. 661,658 filed Nov. 17, 1984 now abandoned.

The present invention relates generally to systems for synthesizing stereophonic audio signals from monophonic audio signals and, more particularly, to a system for generating an electrical signal, encoded with information relating to stereophonic sound reproduction, in response to a monophonic electrical input signal. While the present invention is particularly useful in the broadcast of stereophonic information-encoded signals for television and video cassette recorder reception consistent with the broadcast industry approved format, as will be more apparent hereinafter, the present invention clearly can be used in other applications, such as recording such signals on a magnetic or other recording medium, synthesizing stereophonic sound reproduction in the listening location, such as the home, and many other uses.

More specifically, the advent of "stereo" television broadcasting and reception has created a sudden demand for programming provided with stereophonic information-encoded signals adapted to be processed by (a) receivers equipped with special decoders for producing stereophonic audio signals, and (b) receivers not so equipped for producing monophonic signals (the latter receivers including most television sets available before stereo television was adopted, and accordingly must continue to receive an audio signal which can be used to produce monophonic sound). The format adopted by the broadcast industry provides for the transmission of a monophonic audio signal as the base carrier signal of the transmitted signal and a stereo-encoded signal as a subcarrier signal also part of the transmitted signal. Thus, on a standard television receiver not equipped with a decoder, the base carrier signal will be processed in the same manner as it always has been and produce monophonic sound. However, those receivers equipped with the proper decoder also can process the subcarrier signal and use the subcarrier signal with the base carrier signal to produce stereophonic sound. The base carrier, a monophonic signal, represents the sum components for two channel stereophonic reproduction and, in particular, the sum of the left and right channel signals (L+R). The subcarrier signal, on the other hand, as presently proposed by the industry carries the difference information for two channel stereophonic reproduction and, in particular, the difference between the left and right channel signals (L−R).

Stereo synthesizers are know, such as shown in (a) U.S. Pat. No. 3,670,106 and (b) the references cited therein, including U.S. Pat. Nos. 3,124,649, 3,200,199, 3,219,757 3,311,833 and Schroeder, M. R., "An Artificial Stereophonic Effect Obtained from a Single Audio Signal", JOURNAL OF THE AUDIO ENGINEERING SOCIETY, Vol. 6, No. 2, April 1958, pp. 74–99.

Other references which are of interest and may be material are:

(a) U.S. Pat. Nos. 2,493,638, 3,016,424, 3,156,769, 3,219,757, 3,296,376 and 3,548,101;

(b) Bauer, B. B., "Some Techniques Toward Better Stereophonic Perspective" , IEEE TRANSACTIONS ON AUDIO, May–June, 1963, pp. 88–92;

(c) Schroeder, M. R., "Improved Quasi-Stereophony and Colorless Artificial Reverberation", JOURNAL OF THE ACOUSTICAL SOCIETY OF AMERICA, Vol. 33, No. 8, August 1961, pp. 1061–1064;

(d) Nigro, John, "A Stereodynamic Multichannel Amplifier for Single or Binaural Input", JOURNAL OF THE AUDIO ENGINEERING SOCIETY, Vol. I, No. 4, October, 1953, pp. 287–291;

(e) Lindridge, Charles D., "Multidirectional Reproduction and Re-recording of Music from a Single Sound Source", JOURNAL OF THE AUDIO ENGINEERING SOCIETY, Vol. 2, No. 4, October, 1954, pp. 244–248;

(f) Orban, R., "A Rational Technique for Synthesizing Pseudo-Stereo from Monophonic Sources", JOURNAL OF THE AUDIO ENGINEERING SOCIETY, Vol. 18, No. 2, April, 1970, pp. 157–164;

(g) Lauridsen, H., "Nogle Forsog med Forskellige Former rum Akustic Gengivelse", 47 Ingenioven 906, November, 1954, pp. 906–910 and "Nogle Forsog med et Stereofonisk System", pp. 958–960;

(h) Lochner, J. P. A., et al, "Stereophonic and Quasi-Stereophonic Reproduction", JOURNAL OF THE ACOUSTICAL SOCIETY OF AMERICA, Vol. 32, No. 3, March, 1960, pp. 393–401;

(i) Vermeulen, R., "Stereo Reverberation", JOURNAL OF THE AUDIO ENGINEERING SOCIETY, Vol. 6, No. 2, April, 1958, pp. 124–130;

(j) Skudrzyk, E., "Foundation of Acoustics", Springer, New York and Vienna, pp. 174–175;

(k) Bauer, B. B., "Stereophonic Earphones and Binaural Loudspeakers", JOURNAL OF THE AUDIO ENGINEERING SOCIETY, Vol. 9, No. 2, April, 1961, pp. 148–151;

(l) Gardner, Mark B., "Some Single-and Multiple-Source Localization Effects", JOURNAL OF THE AUDIO ENGINEERING SOCIETY, Vol. 21, No. 6, July/August, 1973, pp. 430∝437; and (m) Office of Science and Technology, "Multichannel Television Sound Transmission and Audio Processing Requirements for the B.T.S.C. System and Amendments to the Rules and Regulations for Multichannel Television Sound", O.S.T. Bulletin No. 60, April 1984.

With respect to the above-identified references, one believed to be pertinent with respect to the present invention is U.S. Pat. No. 3,219,757 issued to Palladino. The latter teaches the generation of two synthesized stereophonic signals in response to a monophonic input signal M by introducing a phase delay to the signal M to produce the signal Md. The signal Md is amplified by a fixed gain A to produce AMd and applied to a matrix with the M signal to produce the M−AMd difference signal which can subsequently be applied to a phase splitter to produce the M−AMd left channel signal and AMd−M right channel signal. Alternatively, the phase delayed signal Md is applied with the monophonic signal to a matrix to produce the sum signal M+Md and the difference signal M−Md. The latter is further differentiated from the sum signal by amplifying the difference signal by a fixed gain A to produce the A(M−Md) signal. The two signals are then applied to a matrix to produce the (M+Md)+A(M−Md) left channel signal and the M(1−A)+Md(1+A) right channel signal. Thus, a difference signal is generated by modifying both the phase and fixed gain of the monophonic signal. This difference signal can be combined with a summed signal derived from the original monophonic and delayed monophonic signals to produce the left and right channel signals. The patented system would be unsatisfactory for stereophonic television transmission and reception, as currently adopted, since both embodiments would either modify the monophonic signal prior to transmission in a manner making it unsatisfactory for reception for receivers not specifically provided with stereophonic decoders, or require special decoders in the receivers in addition to the industry-approved decoder.

Similarly, in Applicants' copending application, Ser. No. 581,660, filed Feb. 21, 1984 now U.S. Pat. No. 4,589,129, and assigned to the present assignee, (issued as U.S. Pat. No. 4,589,129 on May 13, 1986) a multichannel system is described for producing stereophonic encoded signals. While the center channel uses a signal representing the sum information, and is thus by the adopted industry standard a monophonic signal, all of the channel signals are derived from the left and right channel stereo signals, and not from a common monophonic signal.

Further, where the present invention is used in television transmission and/or reception systems, it is important to have the size of the acoustic image match the action on the television screen. Close microphone speech sounds bizarre if it is spread out. Action and music scenes must have strong stereophonic spread to be dramatic enough to feel appropriate to the viewer.

It is a general object of the present invention to provide an improved system for synthesizing a signal encoded with stereophonic information from a monophonic signal and overcoming or reducing the problems of the above-noted prior art.

Another object of the present invention is to provide an improved system for synthesizing a signal encoded with stereophonic information and adapted to be used with a monophonic signal to provide stereophonic sound reproduction.

And another object of the present invention is to provide an improved system for generating a synthesized stereo-encoded signal, in response to a monophonic input signal, consistent with the industry approved stereo-television transmission and reception format.

Yet another object of the present invention is to provide an improved system for generating a synthesized stereo-encoded signal, in response to a monophonic input signal, representative of L−R information.

Still another object of the present invention is to provide an improved system to more closely match the acoustic image with the visual image provided in television programming.

These and other objects of the present invention are achieved by an improved system for generating a signal encoded with stereophonic program information from a monophonic input signal. The system comprises means for generating a stereo-encoded signal containing stereophonic-encoded information such that the stereo-encoded signal can be used with a monophonic signal derived from the monophonic input signal to produce stereophonic signals. The stereo-encoded signal is generated in response to and as a function of at least a portion of the program information of the monophonic input signal so as to control the degree of "stereophonic spread" when the stereo-encoded signal and monophonic signal are used to produce stereophonic signals. The system is particularly adapted for use in the transmission of stereo television signals consistent with the broadcast industry adopted format.

The term "stereophonic spread", as used herein, shall mean the differences produced at the channel outputs of a stereophonic reproduction system during reproduction which combine to produce a synthesized stereophonic spatial effect. The term "stereo signal", as used herein, accordingly means an audio signal providing significant apparent spatial spread obtained from non-identical signals derived from the program information of the audio signal and fed to a plurality of electro-acoustic transducers. In this regard it is well established practice in portions of the recording industry to market as "stereo" products those recorded without stereophonic microphones but processed and mixed to create stereo effect.

In accordance with another aspect of the present invention, the prior art stereophonic synthesizers typically include time-dispersive circuits, such as comb filters or all-pass phase shifters, for defining a plurality of bands, each defining 180° phase shift when the synthesized stereophonic signals are reproduced. Typically, these time-dispersive elements define as many as sixteen bands for large listening areas, such as movie theatres, and fewer bands in systems such as described in U.S. Pat. No. 3,670,106 and the August, 1961 Schroeder article, referenced above. Where these time-dispersive circuits defining sixteen or fewer bands were used, in part, to produce synthesized stereophonic sound for stereophonic television transmission and reception, it was found that such an arrangement typically does not adequately provide the spatial awareness required for stereophonic reproduction over all normal listening positions in the small rooms in which a television viewer usually watches television. In particular, sixteen or fewer bands results in such inferior reproduction due to differing sound quality in different positions in the room because of the "strange" sound produced by the comb filtered effect from each individual speaker, when sound localization is required.

Accordingly, another object of the present invention is to a system for generating a stereophonic information-encoded signal for use in synthesizing stereophonic sound reproduction which overcomes or reduces these problems of the prior art.

Another object of the present invention is to provide an improved system for synthesizing stereophonic sound providing greater stereophonic spread when desired.

And another object of the present invention is to provide an improved system for synthesizing stereophonic sound substantially without excessively apparent comb filter sound effects when localized sound is required.

These and other objects of the present invention are provided by a system including a time-dispersive circuit, preferably in the form of an all-pass phase shifter for defining at least twenty, and preferably more, bands of 180° phase shift throughout the audio spectrum.

Other objects of the present invention will in part be obvious and will in part appear hereinafter. The invention, accordingly, comprises the apparatus possessing the construction, combination of elements and arrangement of parts which are exemplified in the following detailed disclosure, and the scope of the application of which will be indicated in the claims.

For a fuller understanding of the nature and objects of the present invention, reference should be had to the following detailed description taken in connection with the accompanying drawings, wherein.

While the embodiments shown are directed to the synthesis of a stereo-encoded, L−R difference signal from a monophonic input signal for purposes of the standard stereo television transmission and reception format currently adopted by the broadcast industry, it should be appreciated that the present invention may be used to synthesize, from a monophonic signal, a stereo-encoded signal useful in multi-channel stereophonic sound production in which more than two channels are used, such as suggested in:

(a) U.S. Pat. Nos. 3,632,886, 3,944,735;

(b) the references cited therein, including, respectively, U.S. Pat. Nos. 2,714,633, 2,845,491, 3,067,287, 3,067,292, 34,012,237, and 3,786,193, 3,794,781, 3,798,373, 3,812,295, 3,821,471, 3,825,684, 3,829,615, 3,836,715; and (c) Applicants' copending patent application, Ser. No. 581,660, now U.S. Pat. No. 4,589,129 filed Feb. 21, 1984 and assigned to the present assignee (issued as U.S. Pat. No. 4,589,129 on May 13, 1986)

Figure 1:
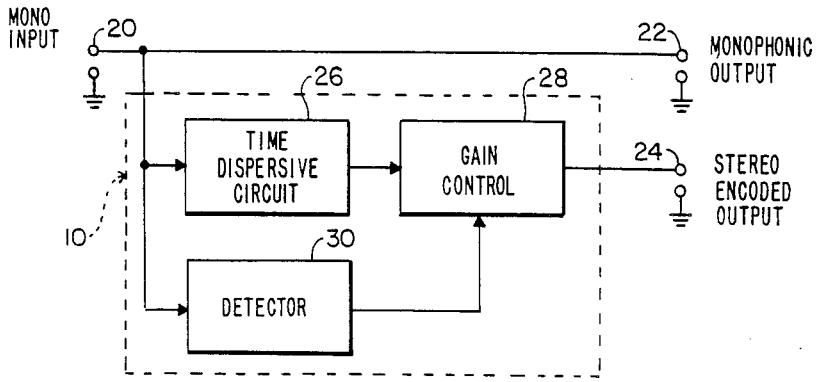
FIG. 1 is a block diagram of one embodiment of the present invention.

Referring to FIG. 1, one embodiment of the present invention includes the system 10 comprising input terminal 20 for receiving a monophonic input signal. A signal path is provided from input terminal 20 and an output terminal 22 for transmitting the monophonic input signal so as to produce a monophonic output signal. As shown, the monophonic output signal is substantially the same as the input signal. However, it should be appreciated that various modifications can be made to the input signal to produce the monophonic output signal without necessarily affecting the monophonic nature of the signal, such as signal compressing, filtering, amplifying, etc. The monophonic output signal is adapted to be used for monophonic audio reproduction in a well-known manner. In a two-channel system, comprising a left and right channel (L and R, respectively), a monophonic signal is usually representative of the sum components L+R and thus represents "on-center" information, when no stereophonic spread is provided.

The term "on-center" information means that if identical speakers are respectively connected to both channels and the channels are "balanced", i.e., the energy transmitted in the two channels will be substantially the same, the virtual sound image created by the speakers will be along a line perpendicular to and bisecting the line between the two speakers. If the system is a multi-channel system with more than two channels, the monophonic signal will still usually represent "on-center" information, where the image will appear to emanate from the center of the combined field created by the speakers used. It will be evident, however, that the image created by the monophonic signal containing the on-center information can be located anywhere, without any stereophonic spread, for example, by merely creating an imbalance in the amount of energy transmitted between the left and right channels in a two-channel system, or modifying the energy levels through a multiple channel system comprising three or more channels. Accordingly, the term "on-center" information is merely used to designate the monophonic reproduction information, without any stereophonic spatial effects, while "off-center" information is used to designate that information providing stereophonic spread when used to synthesize stereophonic reproduction.

In accordance with the present invention, a stereophonic information-encoded signal is generated from at least a portion of the program information in a monophonic input signal and provided at the output terminal 24 without necessarily affecting the monophonic output signal at output terminal 22. The output signal at terminal 24 is encoded with stereophonic reproduction information, i.e., "off-center" information, which when used with the monophonic signal at terminal 22 in a preselected manner (a function of how the signal at terminal 24 is encoded, which in turn depends upon the number of channels used in the reproduction process), is capable of providing stereophonic reproduction. In a two-channel system, this stereophonic information is synthesized difference information between the left and right channels (L−R).

The means, forming a part of the second signal path, for generating the synthesized signal, preferably includes a time-dispersive circuit 26 in the form of an all-pass phase shifter. Circuit 26 defines a plurality of frequency bands, each band providing 360° of phase shift, spaced throughout the audio spectrum, 20 Hz–20 KHz, when the stereo-encoded and monophonic signals are decoded to produce the stereo effect. The exact location of these bands usually is a function of pitch. The circuit 26 thus creates differences in phase and amplitude so as to create stereophonic difference information. While it is known to use all-pass phase shifters in stereo generator systems, such as suggested in U.S. Pat. No. 3,670,106, until the present invention it has only been known to use circuits which define, at most, sixteen bands spaced through the audio spectrum, where such systems were used in a relatively large area, such as movie theatres, and even fewer bands in systems of the type described in U.S. Pat. No. 3,670,106 and the August, 1961 Schroeder article referenced above. Where the present invention is used in stereophonic television transmission, it was found that such an arrangement typically does not adequately provide the spatial awareness normally provided by stereophonic reproduction in the small area in which a television viewer usually watches television. In accordance with one aspect of the present invention, it was unexpectedly discovered that by increasing the number of bands within the audio spectrum, defined by the time-dispersive circuit 26, a great increase in the psychoacoustic effects of spatial awareness occurs. Specifically, as the number of bands are increased beyond twenty, the combed filter sound effects emanating from each speaker on reproduction becomes less pronounced and the perceived stereophonic spread becomes more pronounced so as to more closely represent true stereophonic reproduction. In the preferred embodiment for use with stereo television, the actual number of bands used is forty-eight, although thirty-two have been found to be quite sufficient to synthesize stereophonic reproduction within the small confined area of normal television viewing where the speakers are placed relatively close together.

Figure 2:
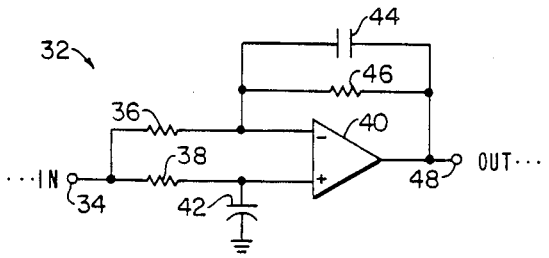
FIG. 2 is a schematic diagram of the preferred time-dispersive element of the circuit for providing a stereo-encoded signal of the FIG. 1 embodiment.

The preferred time-dispersive circuit 26 includes a plurality of time-dispersive elements or sections, one for each 180°. phase shift band. The time-dispersive elements are connected in series, one section being shown in FIG. 2. Section 32 includes an input terminal 34 for receiving the input signal from the input terminal 20 in the case of the first section, and the output from the previous section in the case of each succeeding section. Input terminal 34 is connected through two input resistors 36 and 38 to the respective inverting and non-inverting inputs of operational amplifier 40. The non-inverting input is also connected through capacitor 42 to system ground. The inverting input of amplifier 40 is connected through each of the feedback capacitor and resistor 44 and 46 to the amplifier output 48. The latter provides the output signal of the time-dispersive section and the input signal to the next succeeding section in the case of all of the sections except the last, and the output signal of circuit 26 in the case of the last section. Capacitor 44 is an anti-oscillation capacitor, while resistors 36 and 46 set the gain of the amplifier, preferably set for unity gain. The specific frequency response of the section is set by the time constant determined by resistor 38 and capacitor 42. In the preferred embodiment, where forty-eight such sections are utilized to provide 48 bands within the audio spectrum, the sections 1–48 respectively connected in series are provided with the time constants in TABLE I:

TABLE I

| SECTION | TIME CONSTANT |
|---|---|
| 1,17,33 | 10 microseconds |
| 2,18,34 | 15 microseconds |
| 3,19,35 | 22 microseconds |
| 4,20,36 | 33 microseconds |
| 5,21,37 | 50 microseconds |
| 6,22,38 | 72 microseconds |
| 7,23,39 | 100 microseconds |
| 8,24,40 | 150 microseconds |
| 9,25,41 | 220 microseconds |
| 10,26,42 | 330 microseconds |
| 11,27,43 | 500 microseconds |
| 12,28,44 | 720 microseconds |
| 13,29,45 | 1.0 milliseconds |
| 14,30,46 | 1.5 milliseconds |
| 15,31,47 | 2.2 milliseconds |
| 16,32,48 | 3.3 milliseconds |

Referring again to FIG. 1, the output of circuit 26 is connected to gain control means 28 for variably controlling the signal gain impressed on the signal transmitted through the signal path between input terminal 20 and output terminal 24 in such a manner so as to variably control the stereophonic spread during the synthesized stereophonic reproduction adapted to be provided by the signals at terminals 22 and 24. The means for controlling the signal gain preferably is in the form of a multiplier circuit of the voltage or current-controlled amplifier type described in U.S. Pat. No. 3,714,462 issued Jan. 30, 1973 and referred to in the art as a VCA, although other devices can be used. Generally, the latter type of VCA impresses a signal gain on the input signal as a function of a control signal derived from the input signal. More specifically, the output signal provided by the preferred VCA is a logarithmic function of the sum of the input and control signals.

Figure 4:
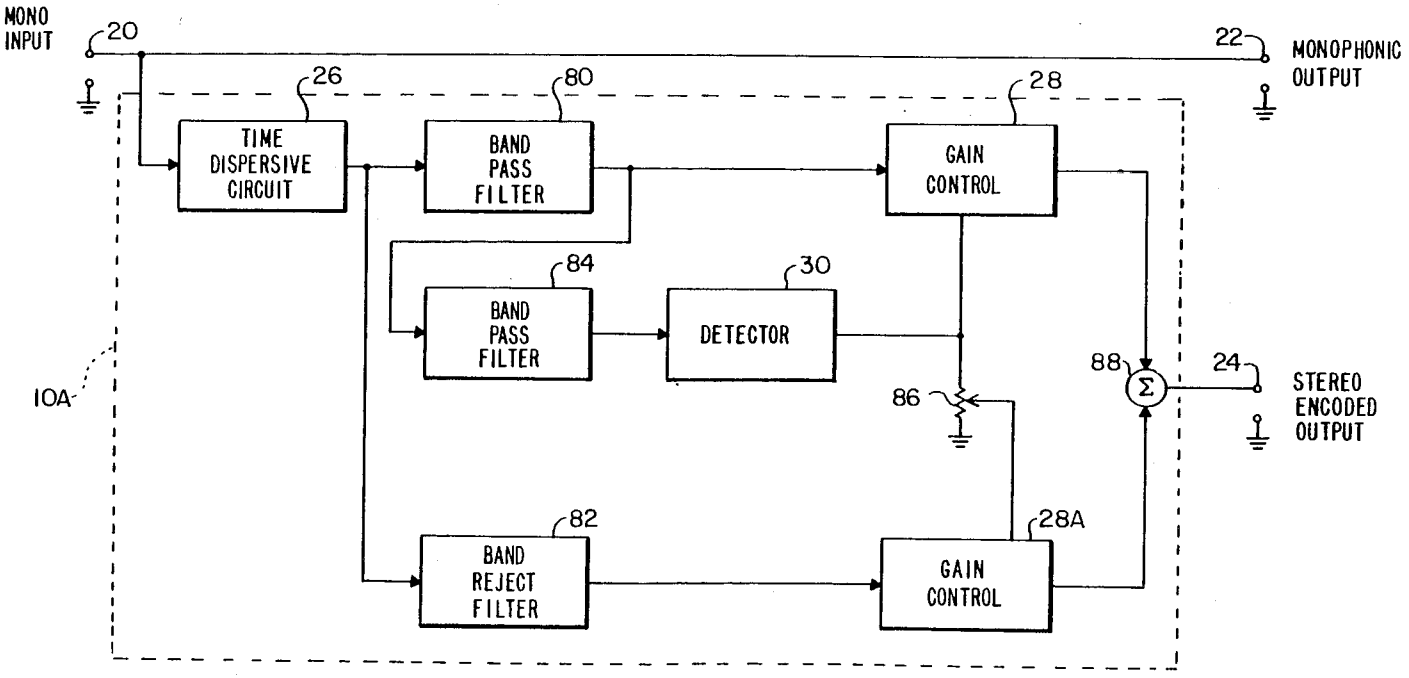
FIG. 4 is a block diagram of the preferred embodiment of the present invention.

The control signal is preferably derived from at least a portion of the program information of the monophonic input signal and may be derived either directly from the monophonic input signal (as in FIG. 1), or from a signal derived from the monophonic input signal (as in FIG. 4). The control signal may be derived from the on-center information contained in the monophonic input signal, the off-center information contained in the monophonic input signal, or both, and may, for example, be generated as a function of the amplitude time-derivative of the input signal and/or the frequency spectra of the input signal (the latter being shown in FIG. 4). The control signal is provided by the detector 30 which preferably generates the control signal so as to control the amount of stereophonic spread so that monophonic signals containing on-center information are reproduced at the center of the field while those containing off-center information will be heard with a strong stereophonic spatial effect. The control signal is preferably generated by a detector of the type described in U.S. Pat. No. 4,404,427 issued Sept. 13, 1983, and incorporated herein by reference. The detector provides a control signal as a function of the amplitude time-derivative of the input signal to the amplifier 28 so as to provide signal attenuation when the monophonic signal is of the type that is to be produced in a localized manner, e.g., fast-changing signal amplitudes, such as impulse noise, closed mike speech and staccato music, and thus is thought to contain on-center stereophonic information. The detector 30 preferably provides signal amplification for those signals adapted to be reproduced with spatial depth, such as those signals whose amplitude moves relatively slowly, e.g., typical music and effects signals, and thus are thought to contain off-center stereophonic information when modified by circuit 26. It may be desirable to control only the amount of attenuation of the signal transmitted over the signal path through VCA 28 without any amplification, and thus the detector 30 may provide the control signal only as a function of the on-center information or off-center information sensed by the detector.

The signal output of the gain control means can be further modified, such as signal compressing or expanding, filtering, amplifying, depending upon the particular use of system 10. Further, while the gain control means 28 is shown connected to the output of the circuit 26, it can be connected between the input terminal 20 and the input of the circuit 26.

In operation, the monophonic input signal is applied to input terminal 20 so as to provide the monophonic output signal at output terminal 22, and an input signal to circuit 26. The circuit 26 modifies the signal so as to provide the desired time-dispersive phase shifting. The circuit output signal is applied to the input of amplifier 28. When the signal detected is of the type containing fast-changing amplitudes, and, therefore, a prominent portion of on-center information, the output of detector 30 provides the appropriate control signal input to amplifier 28 resulting in signal attenuation of the signal provided at the amplifier input. This results in a reduction in the signal at output terminal 24. Similarly, where the signal is slow-moving, and, therefore, contains a prominent portion of off-center information, the amplifier will increase the signal gain impressed on the signal so as to provide a greater signal at the output terminal 24. This provides a greater stereophonic effect since a larger signal at terminal provides greater off-center information provided by filter 26 when the signals provided at output terminals 22 and 24 are decoded. Obviously, the degree that the signal gain varies depends on the amount of on-center and off-center information sensed by detector 30, and thus the amplifier 26 and detector 30 are used to control the amount of stereo spread reproduced when the two output signals are combined, varying from no stereo spread or monophonic, on-center reproduction when total attenuation is provided to maximum stereophonic spread when maximum amplification of the signal at output terminal 24 is provided.

Figure 3:
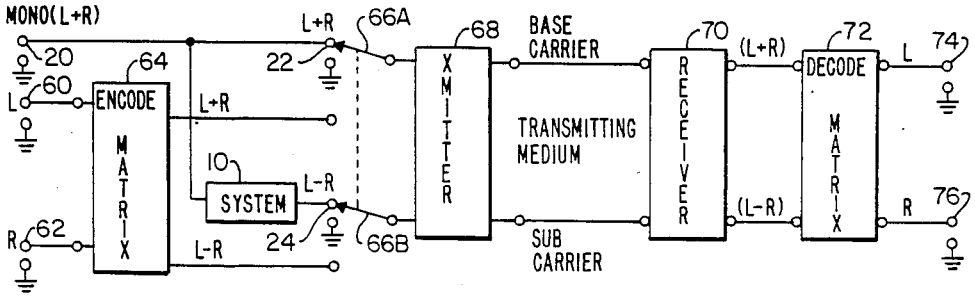
FIG. 3 is a block diagram of a television transmitting and receiving system incorporating the present invention.

The preferred system 10 is used in a stereophonic television transmitting and receiving system of the type adapted to operate in accordance with the broadcast industry adopted format, a simplified version of which is shown in FIG. 3. For a discussion of stereo television see, for example, STEREO REVIEW, Volume 49, No. 7, July, 1984, pp. 37–39. The system generally includes two stereo inputs 60 and 62 for receiving the left and right stereo signals (L and R), when the programming is in stereo. The inputs 60 and 62 are connected to the inputs of an encoding matrix 64 for providing an L+R signal containing the on-center, add information and an L−R signal containing the off-center difference information. A signal representative of the L+R signal is provided through switch 66A to a base carrier modulator of the television transmitter 68, while a signal representative of the L−R signal is applied through switch 66B to a subcarrier modulator of transmitter 68. The transmitter 68 transmits both signals to the receiver 70, which includes a tuner for demodulating at least the base carrier. Where only the base carrier is demodulated, the television will provide monophonic sound. In this regard, the preferred system 10 does not affect the monophonic signal so that it remains unaffected. Where the receiver is equipped to provide stereophonic sound, it will also include a demodulator for demodulating the subcarrier signal. Signals representative of L+R and L−R are provided from the output of the receiver 70 and applied to decode matrix 72 so as to provide the left and right channel output signals at outputs 74 and 76, respectively.

In accordance with one aspect of the present invention, the system 10 is connected with its input for receiving monophonic input program signals and its monophonic output coupled through switch 66A to the transmitter and its encoded output coupled through switch 66B to the transmitter. When monophonic programming is thus provided, switch 66A and 66B can be placed in position to use system 10 for generating the synthesized stereophonic information encoded signals.

It should be appreciated that system 10 can also be used in receivers by connecting system 10 to receive the demodulated monophonic base carrier signal so as to produce the monophonic and stereo-encoded signals.

In the FIG. 1 embodiment, the control signal generated by detector 30 is derived from substantially the entire frequency spectrum of the monophonic input signal applied to input terminal 20. Preferably, however, even greater results can be achieved if the control signal of detector 30 is derived from program information in one or more select frequency bands which have been empirically determined by the present Applicants to contain predominantly either off-center information or on-center information. In the preferred embodiment shown in FIG. 4, the predetermined frequency band containing predominantly "on-center" information is used to generate the control signal. This control signal, in turn, is used to reduce at least a portion of the stereo-encoded output signal at output terminal 24 as a function of the time derivation of the signal energy present within this frequency band. The preferred system 10A of FIG. 4 can also be provided with variable adjustment means so that greater reduction of the portion of the stereo-encoded signal within the predetermined frequency band is provided than the portion of the stereo-encoded signal outside the band.

More specifically, referring to FIG. 4, the system 10A includes all of the components of system 10. In addition, the output of the time-dispersive circuit 26 is connected to the input of bandpass filter 80 and the band stop filter 82. The preferred filter 80 is adapted to pass signal energy within the frequency range of about 200 Hz–1 kHz, the signal energy region where speech is usually predominant in most programs. The filter may be any type of bandpass filter preferably having a roll-off of about 6 dB/octave below 200 Hz and above 1 kHz. Such a filter is well-known and as such is not described in detail. Band stop filter 82 is designed to reject the signal energy within the same frequency band passed by filter 80 so as to provide an output which is the complement of the output of filter 80. For example, filter 82 may be a comparator which subtracts the output of filter 80 from the output of circuit 26. The outputs of filters 80 and 82 are respectively connected to the inputs of gain control means 28 and 28A for variably controlling the signal gain impressed on the signals transmitted from filters 80 and 82, respectively.

The output of filter 80 is also connected to the input of bandpass filter 84 which is designed to pass the same signal energy provided by filter 80, and preferably is designed to pass signal energy within a narrower frequency band than passed by filter 80. Preferably, filter 84 is designed to pass signal energy within the frequency range having a center frequency around 320 Hz–400 Hz where speech is usually predominant in most programs. The filter may be any type of filter having a fairly sharp roll off and preferably is a one-third octave two pole filter having a center frequency of about 320 Hz. The output of filter 84 is connected to the input of detector 30 so that the control signal generated by detector 30 will be of a function of the amount of signal energy present within this frequency range determined by filter 84. The output of detector 30 is applied to the control signal input of each of the gain control means 28 and 28A so as to control the gain impressed on the output signals of filters 80 and 82, respectively. Preferably, each of the gain control means 28 and 28A is set so that each provides unity gain when the control signal is zero, and will provide greater gain reduction as the amplitude of the control signal increases, i.e., the greater the proportion of on-center information present in the monophonic input signal. The relative amounts of gain provided by gain control means 28 and 28A can be adjusted by providing a potentiometer 86 between the output of detector 30 and the control signal input of gain control means 28A. The outputs of gain control means 28 and 28A are summed through summing means 88 and applied to the output terminal 24.

In operation, the monophonic input signal applied to input terminal 20 in FIG. 4 will be processed by circuit 26 and applied to the inputs of filters 80 and 82. Where a predominant portion of the signal energy of the monophonic input signal applied to input terminal 20 is on-center information, a predominant portion of the signal output of circuit 26 will be passed by filters 80 and 84, while only a small amount will be passed by filter 82. Detector 30 will provide a relatively large control signal to gain control means 28 and 28A reducing the gain impressed on the output of filters 80 and 82 so that little of these signals will be applied through summer 88 to the output terminal 24. Thus, the stereo-encoded output signal will be relatively small. This is appropriate since the signal contains predominatly on-center information which is provided by the monophonic output signal at output terminal 22.

On the other hand, where the predominant signal energy provided at the output of circuit 26 is off-center information, outside the bands defined by filters 80 and 84 (such as certain ambient noises), a substantial portion of the signal will be transmitted by filter 82 and applied to gain control means 28A, and only a relatively small signal will be transmitted by filters 80 and 84 to gain control means 28 and detector 30. The control signal generated by the detector will therefore be small. This results in less signal reduction of the signal applied to gain control means 28 and 28A. Since the signal provided by filter 82 is greater than that provided by filter 80 a larger signal is provided to summer 88 by gain control means 28A than gain control means 28. This results in a larger output signal at output terminal 24 which is appropriate since the enhanced signal contains predominantly off-center information.

The foregoing system is an improvement over prior systems in that it can be used to synthesize a stereophonic information-encoded signal to be used with a monophonic signal, both derived from the same monophonic input signal. The present invention is particularly useful in the transmission and reception of stereo television. The use of a greater number of bands defined by circuit 26 provide the required dramatic effect for stereo reproduction necessary for stereo reproduction in a small area usually provided in television viewing.

Since certain changes may be made in the above apparatus without departing from the scope of the invention herein involved, it is intended that all matter contained in the above description or shown in the accompanying drawings shall be interpreted in an illustrative and not in a limiting sense.

We claim:

1. A system for generating a sterophonic information-encoded signal in response to at least a portion of the program information of a monophonic input signal so that said encoded signal can be used with a monophonic signal derived from said monophonic input signal to produce stereophonic sound, said system comprising:

input means receiving said monophonic input signal;

output means providing said stereophonic information-encoded signal; and means, coupled between said input and output means, for generating said stereophonic information-encoded signal as a function of phase shifts created in said monophonic input signal and in response to and as a function of at least a portion of the program information of said monophonic input signal so as to control the degree of sterephonic spread when said stereophonic sound is produced, said means for generating said stereophonic information-encoded signal includes means for shifting the phase of said monophonic input signal as a function of frequency so as to generate a phase shifted signal, said means for shifting the phase of said monophonic input signal includes a time-dispersive circuit, said time dispersive circuit includes an all-pass phase shifter defining at least twenty bands, of 180° phase shift each, throughout said audio range.

2. A system according to claim 1, wherein said means for generating said stereophonic information-encoded signal further includes signal path means for defining a signal path between said input and output means and means disposed in said signal path for controlling the signal gain impressed on signals transmitted over said signal path as a function of at least a portion of the program information of said input signal.

3. A system according to claim 2, wherein said means for controlling said signal gain includes an amplifier for impressing said signal gain on signals transmitted through said signal path, and means responsive to said input signal for generating a control signal to said amplifier for controlling the gain of said amplifier.

4. A system according to claim 3, wherein said amplifier provides an output signal as a logarithmic function of the sum of the input signal to said amplifier and said control signal.

5. A system according to claim 4, wherein said means for generating said control signal is a function of the amplitude time-derivative of said input signal.

6. A system according to claim 3, wherein said means for generating said stereophonic information-encoded signal includes means for shifting the phase of said monophonic input signal as a function of frequency so as to generate a phase shifted signal.

7. A system according to claim 1, wherein said all-pass phase shifter defines forty-eight of said bands throughout said audio range.

8. A system according to claim 1, wherein said means for generating said stereophonic information-encoded signal includes means for generating a first signal primarily representative of on-center information contained in said monophonic input signal, means for generating a control signal as a function of said first signal, means for generating a second signal primarily representative of off-center information contained in said monophonic input signal, means for generating said stereophonic encoded signal in response to said first and second signals and means for reducing said stereophonic information-encoded signal in response to and as a function of said control signal.

9. A system according to claim 8, wherein said means for generating said first signal and said means for generating said control signal each include a band pass filter for passing that signal energy within at least one frequency band typically dominated by speech.

10. A system according to claim 9, wherein said means for generating said second signal includes a band stop filter for rejecting that signal energy within said frequency band typically dominated by speech.

11. A system according to claim 10, wherein said band pass filter of said means for generating said first signal has a pass band between approximately 125 Hz and 500 Hz and said band pass filter of said means for generating said control signal has a pass band between approximately 320 Hz and 400 Hz.

12. A system according to claim 8, wherein said means for generating said stereophonic information-encoded signal further includes means for shifting the phase of said monophonic input signal as a function of frequency so as to produce a phase shifted signal, and said means for generating said first signal and said means for generating said second signal are each responsive to said phase shifted signal.

13. A system according to claim 8, wherein said means for modifying said first and second signals includes means for controlling the signal gain impressed on each of said first and second signals in response to and as a function of said control signal.

14. In a system for generating audio signals for use in television receivers, said system being of the type including means responsive to a program input signal for generating a base carrier signal including a monophonic signal and a subcarrier signal including a stereophonic information-encoded signal adapted to be used with said monophonic signal in select ones of said receivers for producing stereophonic sound and in other ones of said receivers for producing monophonic sound reproduction, wherein the improvement comprises:

means for synthesizing said stereophonic-encoded signal in response to said program signal when said program signal is monophonic, said means for synthesizing including means for shifting the phase of said program signal 180° at least twenty times throughtout the audio range and said means for shifting the phase of said program signal includes a time-dispersive circuit.

15. A system according to claim 11, wherein said time-dispersive circuit includes an all-pass phase shifter, said shifter including at least twenty bands throughout said audio range.

16. A system according to claim 15, wherein said all-pass phase shifter includes forty-eight bands throughout said audio range.

17. A system according to claim 14, further including means for variably controlling the signal gain of said encoded signal so as to control the amount of stereophonic spread when said synthesized stereophonic sound is produced as a function of and in response to said program signals without affecting the signal gain of said monophonic signal.

18. A system according to claim 14, wherein said means for synthesizing said stereophonic-encoded signal includes means responsive to at least a portion of the program information of said input signal for controlling the degree of stereophonic spread when said select ones of said receivers produce stereophonic sound.

19. A system generating audio signals for use in television receivers, said system being of the type including means responsive to a program input signal for generating a base carrier signal including a monophonic signal and a subcarrier signal including a stereophonic information-encoded signal adapted to be used with said monophonic signal in select ones of said receivers for producing stereophonic sound and in other ones of said receivers for producing monophonic sound reproduction, wherein the improvement comprises:

input means for receiving said monophonic signal;

output means for providing said stereo-encoded signal; and time-dispersive means disposed between said input means and output means synthesizing said stereophonic-encoded signal in response to and as a function of at least a portion of the program information of said monophonic signal and for generating at least twenty phase shifts, each of 180°, created in said monophonic signal within the audio range so as to control the degree of stereophonic spread when said select ones of said receivers produce stereophonic sound.

20. A system according to claim 19, wherein said means for synthesizing said stereophonic-encoded signal includes means for shifting the phase of said monophonic input signal as a function of frequency so as to generate a phase-shifted signal.

21. A system according to claim 19, wherein said means for synthesizing said stereophonic information-encoded signal includes signal path means for defining a signal path between said input and output means and means disposed in said signal path for controlling the signal gain impressed on signals transmitted over said signal path as a function of at least a portion of the program information of said input signal.

* * * * *

UNITED STATES PATENT AND TRADEMARK OFFICE

CERTIFICATE OF CORRECTION

PATENT NO. : 4,706,287

DATED : November 10, 1987

INVENTOR(S) : David E. Blackmer et al

It is certified that error appears in the above-identified patent and that said Letters Patent is hereby corrected as shown below:

Claim 1, column 11, line 40, delete "sterophonic" and insert -- stereophonic --, Claim 1, column 11, line 55, delete "sterephonic" and insert -- stereophonic --;

Claim 14, column 13, line 17, delete, "throughtout" and insert -- throughout --; and Claim 15, column 13, line 21, delete "11" and insert -- 14 --.

Signed and Sealed this

Twenty-sixth Day of April, 1988

*Attest:*

*Attesting Officer*

DONALD J. QUIGG

*Commissioner of Patents and Trademarks*